US007055359B2

(12) United States Patent
Liu

(10) Patent No.: US 7,055,359 B2
(45) Date of Patent: Jun. 6, 2006

(54) METHOD FOR FORGING/MOLDING A COARSE BLANK OF AN OIL CYLINDER

(75) Inventor: Chang Fa Liu, Taichung (TW)

(73) Assignee: Jinn Ruey Industries Co., Ltd., Taichung (TW)

( * ) Notice: Subject to any disclaimer, the term of this patent is extended or adjusted under 35 U.S.C. 154(b) by 143 days.

(21) Appl. No.: 10/899,487

(22) Filed: Jul. 26, 2004

(65) Prior Publication Data

US 2006/0016237 A1 Jan. 26, 2006

(51) Int. Cl.
*B21D 22/00* (2006.01)

(52) U.S. Cl. ..... 72/356; 72/267; 72/357; 72/358; 29/888.06

(58) Field of Classification Search ..... 72/267, 72/357, 356, 358; 92/169.1, 165 R; 29/888.06
See application file for complete search history.

(56) References Cited

U.S. PATENT DOCUMENTS 1,328,276 A * 1/1920 Ernest ..... 29/888.06
2,424,075 A * 7/1947 Brauchler ..... 72/354.6
6,012,288 A * 1/2000 Gualdoni et al. ..... 60/562
6,474,127 B1 * 11/2002 Bonde ..... 72/356

* cited by examiner

*Primary Examiner*—Dmitry Suhol

(57) ABSTRACT

A method for forging/molding a coarse blank of an oil cylinder, including steps of: placing burn-in softened aluminum material into a preheated mold; using a first punch head to first forge the aluminum material in the mold cavity from outer side of the molding hole so as to form a blank body of the oil cylinder with a first end cap, a second end cap and a shorter cylinder body; moving out the first punch head and connecting an extension mold with the mold; and immediately using a second punch head to secondarily forge the blank body in the mold cavity from outer side of the extension hole and making the end section of the second punch head extend into the mold cavity to a position near the inner end of the mold cavity, whereby the cylinder body of the blank body outward axially extends to the extension mold into a predetermined length so as to form the oil cylinder.

4 Claims, 6 Drawing Sheets

METHOD FOR FORGING/MOLDING A COARSE BLANK OF AN OIL CYLINDER

BACKGROUND OF THE INVENTION

The present invention is related to a method for forging/molding a coarse blank of an oil cylinder. According to this method, burn-in softened aluminum material is first forged and molded into a blank body of the oil cylinder and then the blank body is continuously secondarily forged and molded into a coarse blank of the oil cylinder.

FIG. 7 shows a general oil cylinder 9 including a cylinder body 91 and two end caps 92, 93 disposed at two ends of the cylinder body 91. The two end caps 92, 93 are respectively formed with oil inlet 921 and oil outlet 931. A piston rod 94 passes through at least one end cap. The two end caps are serially connected by four bolts 95 to form the oil cylinder. The end caps are mostly square and apparently protrude from the circumference of the cylinder body. conventionally, the end caps and the cylinder body are separately manufactured and then the end caps are connected with two ends of the cylinder body by means of welding or screws. Such manufacturing procedure has poor efficiency. Moreover, in the case that the end caps are not truly connected with the cylinder body, the oil will leak from the oil cylinder. Besides, the four bolts must have a length in accordance with the length between the end caps so that the cost is higher. In order to fixedly mount the oil cylinder in a predetermined position, one of the end caps is formed with a lug for a screw or a pivot shaft to pass therethrough.

SUMMARY OF THE INVENTION

It is therefore a primary object of the present invention to provide a method for forging/molding a coarse blank of an oil cylinder. By means of a continuous forging operation, an oil cylinder with two end caps and a hollow cylinder body can be manufactured.

According to the above object, the method for forging/molding the coarse blank of the oil cylinder includes steps of: placing burn-in softened aluminum material into a preheated mold; using a first punch head to first forge the aluminum material in the mold cavity from outer side of the molding hole so as to form a blank body of the oil cylinder with a first end cap, a second end cap and a shorter cylinder body; moving out the first punch head and connecting an extension mold with the mold; and immediately using a second punch head to secondarily forge the blank body in the mold cavity from outer side of the extension hole and making the cylinder body of the blank body outward axially extend into a predetermined length so as to form the oil cylinder.

The present invention can be best understood through the following description and accompanying drawings wherein:

DETAILED DESCRIPTION OF THE PREFERRED EMBODIMENTS

Figure 1:
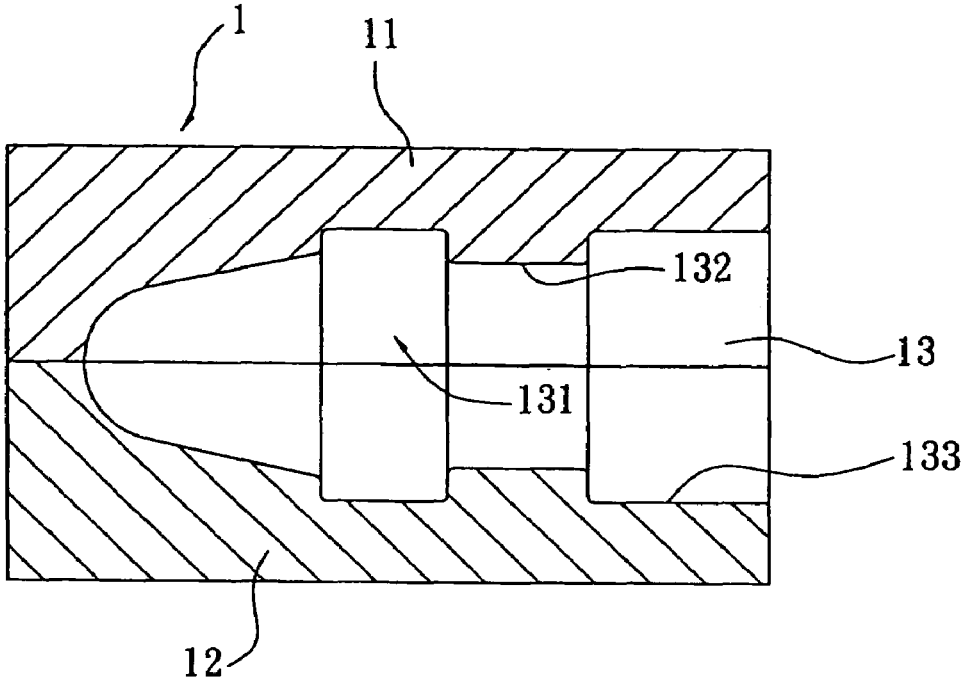
FIG. 1 is a plane sectional view of the mold of the present invention.
Figure 2:
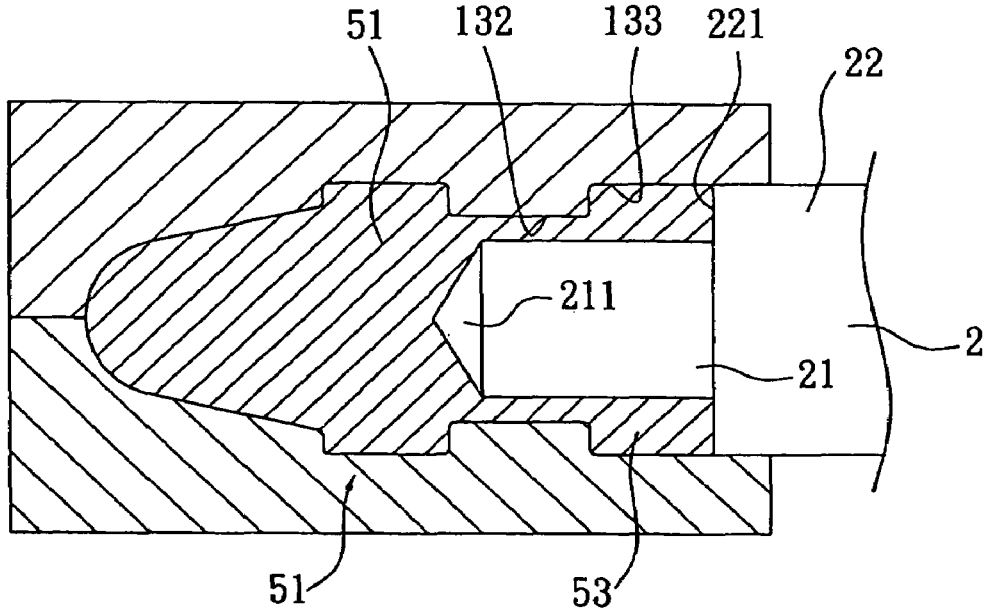
FIG. 2 is a plane sectional view showing that aluminum material is forged in the mold of the present invention to form a blank body of an oil cylinder.
Figure 3:
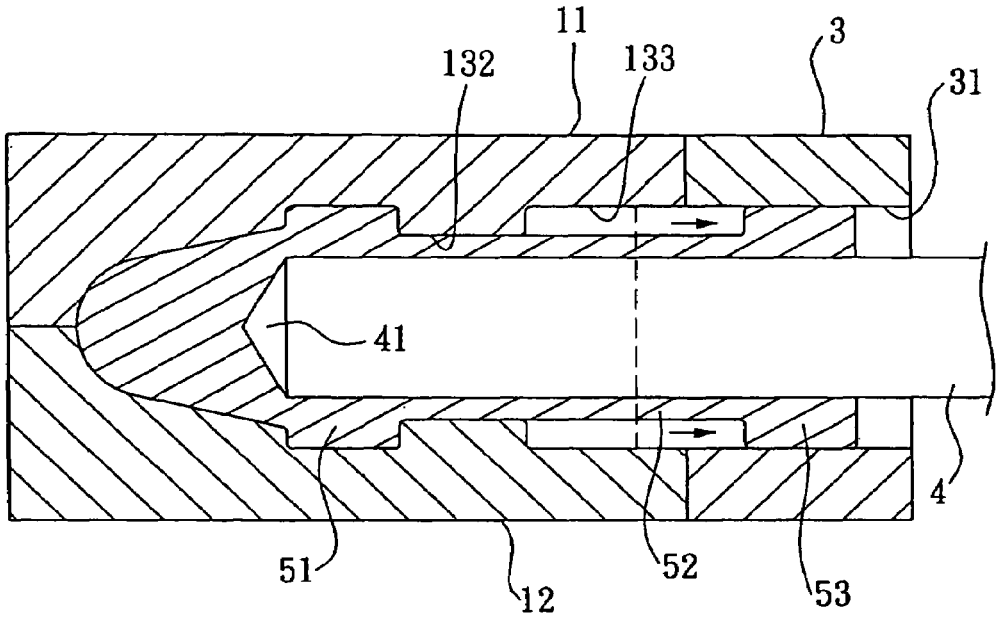
FIG. 3 is a plane sectional view showing that blank body of the oil cylinder is secondarily forged in the mold of the present invention.
Figure 4:
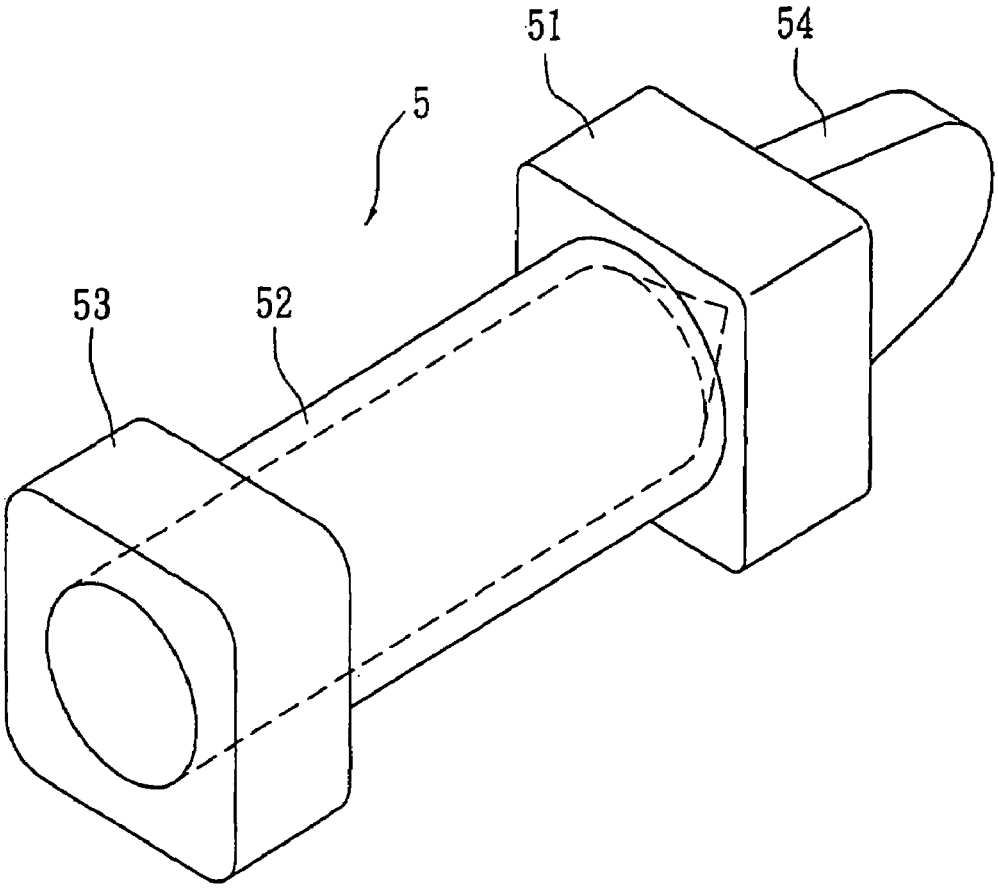
FIG. 4 is a perspective view of the completed coarse blank of the oil cylinder of the present invention.

Please refer to FIGS. 1 to 4. The coarse blank 5 of the oil cylinder of the present invention as shown in FIG. 4 is made with a mold set by continuous forging. The mold set includes an upper mold section 11 and a lower mold section 12 which are mated to form a mold 1 as shown in FIG. 1. The mating sides of the two mold sections are symmetrically formed with a mold cavity 13. An inner end of the mold cavity 13 has an end cap molding section 131 with a profile corresponding to a first end cap 51 of the oil cylinder. The mold cavity 13 further has a straight tunnel 132 adjacent to the end cap molding section 131. The cross-section of the straight tunnel 132 corresponds to the cross-section of the cylinder body 52 of the oil cylinder. The straight tunnel has a length shorter than the axial length of the cylinder body. An outer end of the straight tunnel 132 is a molding hole 133 coaxially extending from the straight tunnel 132. The cross-section of the molding hole corresponds to the profile of the outer circumference of the second end cap 53 of the oil cylinder.

The mold set further includes a first punch head 2. One end of the first punch head 2 has a punch rod 21 with a smaller diameter. An end section 211 of the punch rod is conic, while the other end of the punch rod is adjacent to an end cap molding section 22. The end cap molding section 22 is a cylindrical section adapted to the molding hole. One side of the end cap molding section 22 adjacent to the punch rod has a molding configuration 221 corresponding to the profile of the second end cap 53 of the oil cylinder. Accordingly, the punch rod has a sufficient length for extending the front end of the punch rod into a position of a neck section 134 adjoining the straight tunnel 132 with the molding hole 133.

The mold set further includes an extension mold 3 having an extension hole 31 as an elongated section of the molding hole.

The mold set further includes a second punch head 4 which is a straight elongated rod with a diameter equal to the diameter of the punch rod 21. An end section 41 of the second punch head 4 is conic.

The method for forging/molding the coarse blank of the oil cylinder of the present invention includes steps of:

(a) placing burn-in softened aluminum material into the preheated mold 1;

(b) using the first punch head 2 to first forge the aluminum material in the mold cavity 13 from outer side of the molding hole 133 as shown in FIG. 2 so as to form a blank body 50 of the oil cylinder with a first end cap 51, a second end cap 53 and a shorter cylinder body;

(c) moving out the first punch head and connecting the extension mold with the mold 1 as shown in FIG. 3;

(d) immediately using the second punch head 4 to secondarily forge the blank body 50 in the mold cavity 13 from outer side of the extension hole and making the end section of the second punch head extend into the mold cavity to a position near the inner end of the mold cavity, whereby the aluminum material of middle section of the blank body is squeezed by the second punch head to outward extend along the diameter and axis of the straight tunnel 132 into a predetermined length, the end cap 53 of the blank body 50 being also outward pushed by the extending middle section of the blank body so as to form the oil cylinder.

Figure 5:
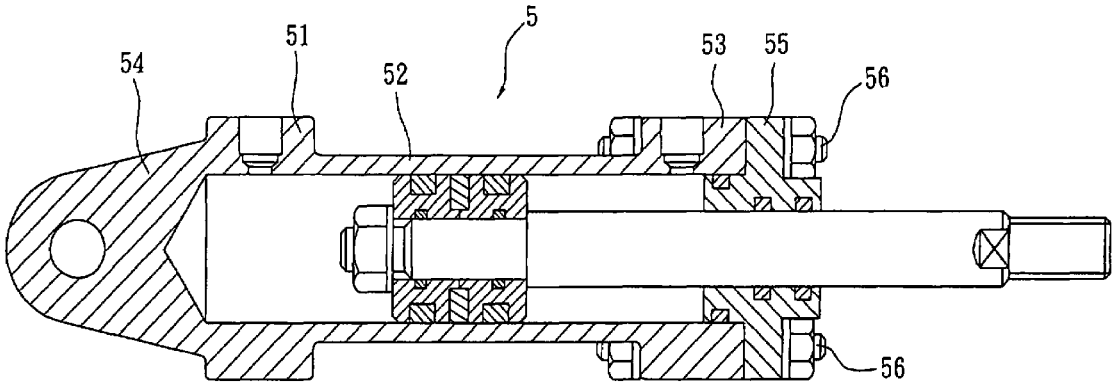
FIG. 5 is a plane sectional view showing that the coarse blank of the oil cylinder is further processed and assembled.
Figure 6:
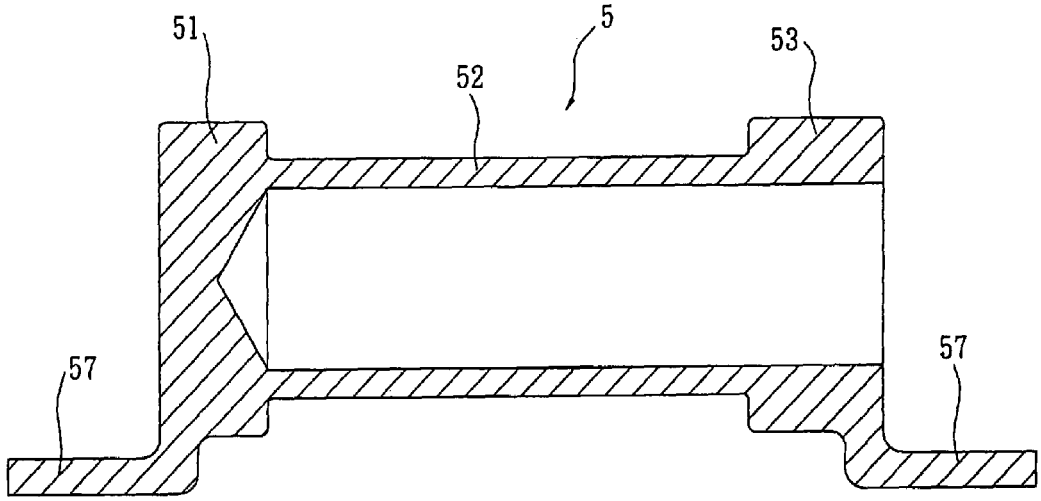
FIG. 6 is a sectional view of another embodiment of the coarse blank of the oil cylinder of the present invention.
Figure 7:
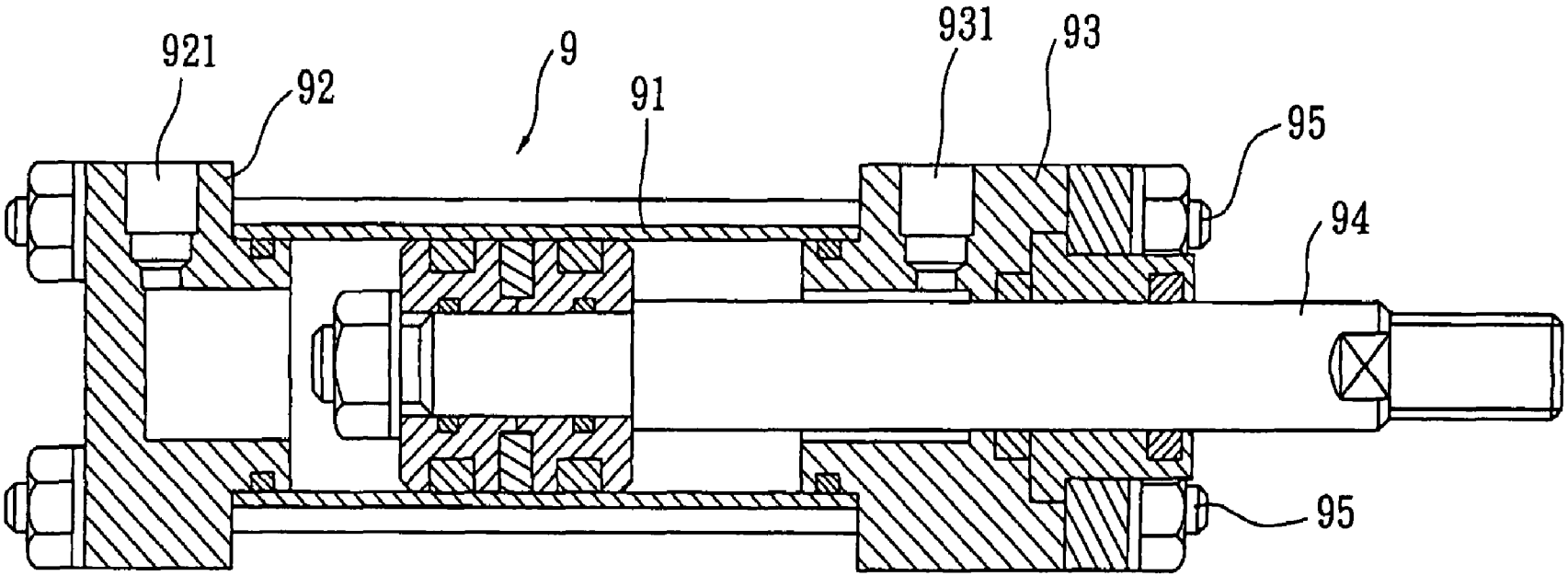
FIG. 7 PRIOR ART
FIG. 7 is a sectional assembled view of a conventional oil cylinder.

According to the above arrangement, the present invention has the following advantages:

1. The first end cap, second end cap and cylinder body are integrally molded without any seam. Therefore, the leakage of oil can be avoided.
2. The first end cap can be integrally molded with a lug 54 as shown in FIG. 4 as necessary. Alternatively, as shown in FIG. 6, the first end cap and the second end cap can be respectively molded with two lugs 57.
3. FIG. 5 shows that the oil cylinder of the present invention is further processed and assembled. The sealing cap 55 disposed on the second end cap 53 can be fixed simply by means of short screws 56. Therefore, the shortcoming existing in the conventional elongated bolts is eliminated.
4. The oil cylinder can be continuously forged by means of the same forging equipment. Therefore, the manufacturing efficiency is enhanced. Also, the cylinder body can be simultaneously molded with a hollow. This saves the successive processing and assembling time.

The above embodiments are only used to illustrate the present invention, not intended to limit the scope thereof. Many modifications of the above embodiments can be made without departing from the spirit of the present invention.

What is claimed is:

1. A method for forging/molding a coarse blank of an oil cylinder, comprising steps of:

(a) placing burn-in softened aluminum material into a preheated mold having a mold cavity, an inner end of the mold cavity having an end cap molding section with a profile corresponding to a first end cap of the oil cylinder, the mold cavity further having a straight tunnel adjacent to the end cap molding section, the cross-section of the straight tunnel corresponds to the cross-section of the cylinder body of the oil cylinder, the straight tunnel having a length shorter than the axial length of the cylinder body, an outer end of the straight tunnel being a molding hole coaxially extending from the straight tunnel, the cross-section of the molding hole corresponding to the profile of the second end cap of the oil cylinder; and (b) using a first punch head to first forge the aluminum material in the mold cavity from outer side of the molding hole so as to form a blank body of the oil cylinder with a first end cap, a second end cap and a shorter cylinder body, one end of the first punch head having a punch rod with a smaller diameter, an end cap molding section being adjacent to the punch rod, one side of the end cap molding section adjacent to the punch rod having a molding configuration corresponding to the profile of the second end cap of the oil cylinder;

(c) moving out the first punch head and connecting an extension mold with the mold, the extension mold having an extension hole as an elongated section of the molding hole; and (d) immediately using a second punch head to secondarily forge the blank body in the mold cavity from outer side of the extension hole so as to make the cylinder body of the blank body outward axially extend into a predetermined length to form the oil cylinder, the second punch head being a straight elongated rod with a diameter equal to the diameter of the punch rod, an end section of the second punch head extending into the mold cavity to a position near the inner end of the mold cavity.

2. The method for forging/molding the coarse blank of the oil cylinder as claimed in claim 1, wherein in step (a), the mold is composed of an upper mold section and a lower mold section which are mated to form the mold, the mold cavity being symmetrically formed on the mating sides of the two mold sections about the axis of the straight tunnel.

3. The method for forging/molding the coarse blank of the oil cylinder as claimed in claim 1, wherein in step (b), the punch rod has a sufficient length for extending a front end of the punch rod into a position of a neck section adjoining the straight tunnel with the molding hole.

4. The method for forging/molding the coarse blank of the oil cylinder as claimed in claim 1, wherein the end section of the punch rod and the end section of the second punch head are conic.

* * * * *